US007954293B2

(12) United States Patent
Nielsen

(10) Patent No.: US 7,954,293 B2
(45) Date of Patent: Jun. 7, 2011

(54) PANELS AND SYSTEMS OF SUCH PANELS FOR INSTANCE FOR SUSPENDED CEILINGS

(75) Inventor: Jesper Nielsen, Copenhagen Ø (DK)

(73) Assignee: Soft Cells A/S, Ebeltoft (DK)

( * ) Notice: Subject to any disclaimer, the term of this patent is extended or adjusted under 35 U.S.C. 154(b) by 909 days.

(21) Appl. No.: 10/593,566

(22) PCT Filed: Jan. 27, 2005

(86) PCT No.: PCT/IB2005/050349

§ 371 (c)(1),
(2), (4) Date: Oct. 10, 2007

(87) PCT Pub. No.: WO2005/073482

PCT Pub. Date: Aug. 11, 2005

(65) Prior Publication Data

US 2008/0066394 A1 Mar. 20, 2008

(30) Foreign Application Priority Data

Jan. 28, 2004 (EP) ..... 04001760
Sep. 28, 2004 (EP) ..... 04022999

(51) Int. Cl.
*E04B 9/00* (2006.01)

(52) U.S. Cl. ..... 52/506.01; 52/506.06; 52/506.08; 52/222; 52/273; 106/327; 106/371

(58) Field of Classification Search ..... 52/506.01, 52/506.06, 506.08, 222, 273, 63, 656.7; 160/327, 160/371

See application file for complete search history.

(56) References Cited

U.S. PATENT DOCUMENTS 2,897,889 A 8/1959 Kessler
3,165,110 A * 1/1965 Brooks ..... 135/124
3,186,129 A 6/1965 Blood
(Continued)

FOREIGN PATENT DOCUMENTS

DE 21 29 051 12/1972
(Continued)

OTHER PUBLICATIONS

European Patent Office, Extended European Search Report, May 7, 2010, EP Application No. 09000596.8.

*Primary Examiner* — Brian E Glessner
*Assistant Examiner* — James J Buckle, Jr.
(74) *Attorney, Agent, or Firm* — Stites & Harbison PLLC; Douglas E. Jackson

(57) ABSTRACT

According to the present invention there is provided a system of panels which could for instance be used for a suspended ceiling comprising one or more rows (R1, R2, . . . ) of panels (2), where one or more of the panels (2) of a given row can be moved from a first, upper level (a), where the panels are fixed relative to the system to a second, lower level (b), where the panels can be displaced along and underneath panels situated at the first level, thereby providing access through the system of panels to the space above or behind the panels. According to the invention there is furthermore provided panels for such systems, the panels comprising a substantially rigid frame (6, 12), the frame being furthermore provided with means for cooperation with mating means on a suspension and guide system, thereby allowing said movement from one level to the other and vice versa and said displacement. The frame defines an open, central region, over which a suitable, flexible material can be stretched and there is disclosed alternative attachment means for this material to the frame. The system of panels according to the invention facilitates access to the region above or behind the panels and also transport of the panels to the site of application as well as replacement or change of appearance of the panels on site.

34 Claims, 16 Drawing Sheets

U.S. PATENT DOCUMENTS

| | | | | |
|---|---|---|---|---|
| 3,374,597 | A * | 3/1968 | Whitener | 52/656.7 |
| 3,791,076 | A * | 2/1974 | Gahler | 52/2.17 |
| 4,195,455 | A * | 4/1980 | Chalmers et al. | 52/94 |
| 4,522,007 | A * | 6/1985 | Oehlert | 52/506.1 |
| 4,640,064 | A * | 2/1987 | Goodworth, II | 52/506.08 |
| 4,696,142 | A * | 9/1987 | Mieyal et al. | 52/506.08 |
| 4,898,087 | A | 2/1990 | Fitzner et al. | |
| 4,901,485 | A * | 2/1990 | Menchetti et al. | 52/145 |
| 4,962,612 | A * | 10/1990 | Kuwano et al. | 52/506.06 |
| 5,209,029 | A * | 5/1993 | Foerst | 52/63 |
| 6,108,994 | A | 8/2000 | Bodine | |
| 6,431,251 | B1 * | 8/2002 | Yerusalim et al. | 160/327 |
| 6,499,262 | B1 | 12/2002 | Pinchot et al. | |
| 6,574,936 | B1 * | 6/2003 | Anderson, Sr. | 52/506.06 |
| 6,722,096 | B2 * | 4/2004 | Von Arx et al. | 52/511 |
| 7,607,268 | B2 * | 10/2009 | Scherrer et al. | 52/273 |
| 2003/0182894 | A1 | 10/2003 | Galsgaard et al. | |
| 2007/0283656 | A1 * | 12/2007 | Anderson | 52/506.06 |

FOREIGN PATENT DOCUMENTS

| | | | |
|---|---|---|---|
| DE | 25 31 026 | | 1/1977 |
| DE | 30 24 110 | | 1/1982 |
| DE | 3916687 | A1 * | 11/1990 |
| DE | 94 10 031 | | 9/1994 |
| DE | 200 11 581 | | 9/2000 |
| DE | 101 45 244 | | 4/2003 |
| EP | 246391 | A1 * | 11/1987 |
| EP | 0 855 477 | | 7/1998 |
| FR | 2664633 | A1 * | 1/1992 |
| FR | 2688551 | | 9/1993 |
| FR | 2733805 | | 11/1996 |
| FR | 2 741 099 | | 5/1997 |
| WO | WO 01/42667 | | 6/2001 |
| WO | WO 03/025302 | | 3/2003 |

* cited by examiner

PANELS AND SYSTEMS OF SUCH PANELS FOR INSTANCE FOR SUSPENDED CEILINGS

TECHNICAL FIELD

The present invention relates to panels and systems of such panels for covering boundaries of a room and more particularly for panels and systems hereof intended for use as a suspended ceiling.

BACKGROUND OF THE INVENTION

A large number of different types of panels and systems of panels for covering boundaries of a room, leaving a space between the system of panel and the solid boundary of the room for accommodation of installations such as light armatures, heating or air-conditioning installations, etc. are well-known within the art. As a typical example of such systems of panels, a suspended ceiling could be mentioned.

In the present context it would be relevant to subdivide panels used for such systems into two different classes: (1) panels formed as a single body of a sufficiently rigid material and (2) panels formed by a rigid frame, over which a relatively thin sheet of material is suspended, the sheet thus forming the major portion of the surface of the panel.

Relating to the first of the above classes, EP 0 979 908 A2 discloses a ceiling panel and a system of such panels, where the panels are unitary pieces of a material of a suitable rigidity, as for instance mineral fibre, fibreglass, wood, metal, plastic, etc. and where typical dimensions of the panels are approximately 60 cm×60 cm. The edge regions of the panels are provided with laterally extending kerfs, extending into the material of the panels, for releasable engagement with a suspending structure of rails hung from the ceiling above the panels. When one or more panels have to be removed, for instance to provide access to installations above the panels, each panel is released from its engagement with the rails and removed entirely from the ceiling.

Panels and a system of such panels bearing some resemblance with the above-mentioned system of panels is disclosed in US 2003/0182894 A1. The panels according to the latter system are also hung from a system of rails attached to the ceiling above, these rails being in engagement with longitudinally extending grooves formed along the edge portions of the panels in such a manner that a given panel can be removed from the system by lifting one longitudinal edge portion hereof from the corresponding rail, after which the panel can also be released from the rail running along the opposite longitudinal edge portion hereof. After this the panel can be removed entirely from the system.

Examples of systems of panels, where the panels belong to the second of the above classes, are disclosed in the following documents:

GB 1 001 485 thus discloses systems of panels where the panels comprise a rigid frame to be supported on a system of grids for instance as a suspended ceiling. The document focuses on the attachment of a film of flexible material to the surrounding frame and in order to obtain a reliable and durable attachment of the film to the frame the edge portions of the film are made thicker and provided with an inwardly facing groove for engagement with a similar flange-like protrusion running along the outer edge of the frame. Due to the resiliency of the film, the film can be stretched over the frame and held in place by the tension in the film.

EP 0 855 477 discloses a system of panels forming a suspended ceiling, where the panels are hung from a system of rails attached to the ceiling. The system of rails provides for the possibility to move the panels from an upper level, where the panels form a closed surface to a lower level, where access can be obtained to the space between the panels and the ceiling. In order to move the panels from the upper to the lower level, the panels have to be lifted from the supporting rail system and displaced laterally, after which they can be lowered to the lower level and displaced parallel under those adjacent panels still left in the tipper level. Thus, movement from the upper to the lower level requires a series of operations, i.e. the lifting of panels followed by a transversal movement taking place above the upper level followed by lowering of the panels to the second level and finally a transversal movement in the opposite direction relative to the first transversal movement in order to bring the panels to rest on attachment means at the lower level of the system.

U.S. Pat. No. 6,499,262 B1 discloses panels for use in a suspended ceiling, the panels comprising a rigid frame over which a thin fabric can be stretched and attached to the frame. In addition to the fabric, the panels disclosed in this document also comprise various layers of material introduced to provide acoustic damping effect and to reduce acoustic transmission through the panel. The fabric is attached to the frame by tucking the fabric into a crevice formed between the main body of the frame and a resilient leg portion pressing against the main body. The leg portion and the adjacent part of the main body of the frame is furthermore provided with a pattern of teeth for attaining a secure grip on the fabric introduced between the main body and the leg. During mounting of the fabric, the fabric can be tucked into said crevice by means of a thin blade or putty knife, which can also be applied for subsequent removal of the fabric, although it is also possible to remove the fabric simply by pulling in it with a sufficient force.

DISCLOSURE OF THE INVENTION

It is a characteristic feature of most of the systems of panels mentioned above that access to the space behind the panels requires that one or more panels be removed from the system. This can be quite inconvenient, especially if the dimensions of the panels are relatively large. Removal of the panels and temporarily placement of these may furthermore increase the risk of damage to the panels. In handling of large panels, preferably only a few and simple movements of the panels should be aimed at and it is furthermore important that the panels are not likely accidentally to become detached from the suspending system as this could damage the panels and other objects below the panels and even be hazardous to persons in the vicinity of the panels.

On this background, it is an object of the present invention to provide a system of panels primarily for suspension from a ceiling, although a system of panels according to the invention could also be used to cover other surfaces of a room, for instance as a wall-covering system, where some or all of the panels can be moved from their normal position in the system in order to provide access to the space behind/above the panels without the necessity to remove the panels from the system.

According to the invention, this object is attained with a system of panels for covering surfaces of a room or for creating additional boundaries of a room, such as a suspended ceiling, comprising one or more row(s) (R1, R2 . . . ) of panels and a suspension and guide system for said panels (2), where the suspension and guide system is adapted for suspension and guiding of the panels (2) in such a manner that at least some of the panels of a given row (R1, R2 . . . ) can be moved from a first level to a second level, in which latter level the panels can be displaced along panels situated at the first level, thereby to provide access through the system of panels.

According to a specific embodiment of the system, the suspension and guide system comprises a plurality of substantially U-shaped channels, one such channel being provided between each adjacent row of panels, the channels at one level being provided with holder means located at predetermined positions along the longitudinal extension of the rows for releasable engagement with mating means provided on the panels for holding the panels at fixed positions along the corresponding row, when the panel is located at the first of said levels, and that the suspension and guide system furthermore comprises rail means at the second level for displaceable engagement with mating means provided on the panels, such that the panels, when located at the second of said levels, can be displaced in the longitudinal direction along the rows in parallel relationship to panels located at the first level.

Although one embodiment of the system according to the invention is characterised by the above-mentioned channels being provided between adjacent rows of panels it is also possible to omit the channels and replace them by a narrow attachment means comprising said holder means and said rail means in such a manner that adjacent rows of panels are located in very close proximity to one another, the rows of panels thereby forming substantially the entire surface area of the system of panels. It is of course also possible to combine these two possibilities, i.e. to place channels between some of the rows of panels and not between others in any desired pattern.

It is a further object of the present invention to provide suitable panels for the system described above.

Specifically it is an object to provide panels of a design to facilitate transport of the panels to the application site and installation of the panels on site.

It is a further object to provide panels with a surface which can be replaced (for instance in case of necessary repair or in order to change the appearance and/or physical characteristics of the panel/system of panels).

According to the invention there is thus provided a panel for use in a system of panels as described above, where the panel comprises a substantially rigid frame, where the frame is provided with holder means for releasable retainment of the panel to the suspension and guide system described above and displacement means allowing displacement of the frame relative to the system.

Thus, according to the invention there is provided a panel, where the panel is defined by a substantially rigid frame surrounding an opening of for instance a rectangular or square shape, said opening being covered by a flexible sheet of material and during application of the panels fixed to the frame in such a manner that the sheet extends substantially planar over said opening, the frame being provided with attachment means distributed along the frame for fixing the sheet of flexible material in said substantially planar manner.

According to a preferred embodiment of the panel according to the invention said means for fixing the sheet of material allows dismantling of the sheet of material from the frame, without the necessity to dismantle the panel from a system, in which it is applied.

By providing panels essentially comprising a rigid, surrounding frame and a sheet of material for suspension on this frame, a number of advantages are attained over panels consisting of a single, integrated element such as a wood or gypsum panel.

Prior to installation of the panels on site, the frame and the sheet material can be transported to the site of application as separate entities, the flexible sheet material for instance rolled up on one or more rolls, which will be highly advantageous both from the point of view of saving space in a transport vehicle and to minimise the risk of damage to the surface of the material. If desired the frames may also be transported in a dismantled condition and assembled on site.

The application of a thin, flexible sheet material offers the possibility to place acoustic devices, loudspeakers, alarm devices and/or light-emitting means behind the sheet for communication through the sheet without specially formed apertures in the panels.

In case of damage to the surface of a panel, or in case it is desired to change the appearance and/or other physical characteristics of the panel this can be done by simply dismantling the sheet and apply a new sheet to the frame, an operation which can easily be accomplished on site.

BRIEF DESCRIPTION OF THE DRAWINGS

The invention will now be described in more detail with reference to the accompanying drawings, in which.

DETAILED DESCRIPTION OF THE INVENTION

In the following, a detailed description of presently preferred embodiments of the invention is given. The embodiments shown specifically relate to a suspended ceiling formed by panels according to the present invention, but it is understood that minor modifications of the suspension and guide means shown herein will enable the panels according to the invention to be used to form systems for covering walls, partitions etc. without departing from the basic spirit of the invention. Such alternative applications of systems of panels according to the invention are also covered by the independent claims and at least some of the corresponding dependent claims.

Figure 1:
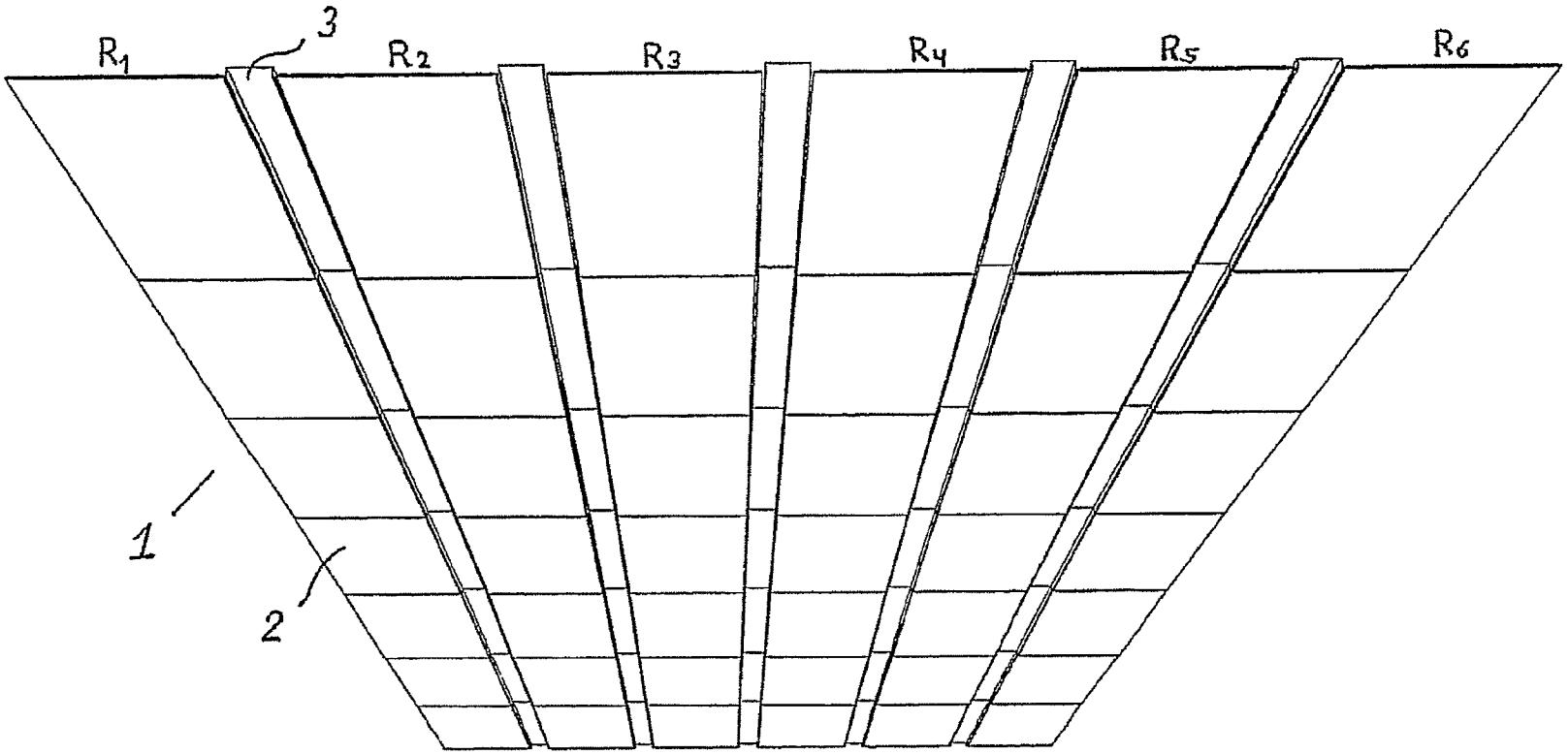
FIG. 1 is a perspective view of a system of panels according to one embodiment of the invention.

With reference to FIG. 1, there is thus shown a perspective view of one embodiment of a system of panels according to the invention used to form a suspended ceiling. The system comprises a plurality of rows R1, R2 . . . R6 of panels 2, each of the rows being in this embodiment separated from each other by intermediate channels 3, which can be used for the installation of for instance light armatures, sprinklers, loudspeakers etc. It should be understood, however, that the presence of these intermediate channels 3 is not a necessity, and that they could either be omitted altogether or some of the channels could be omitted, whereby corresponding adjacent rows would be placed in close proximity to each other.

Figure 2:
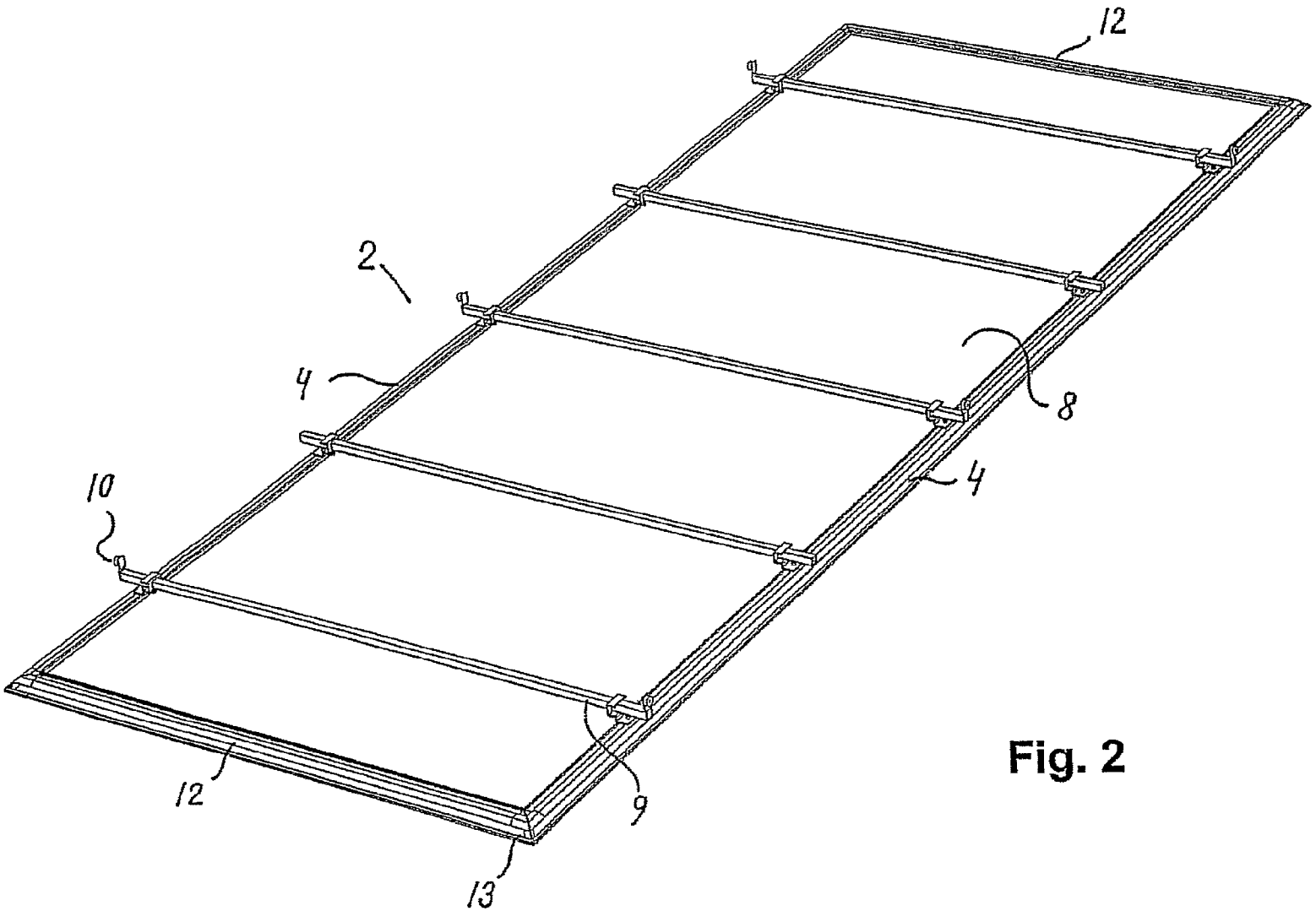
FIG. 2 is a perspective view of a panel according to the invention seen from the rear side hereof.

With reference to FIG. 2, there is shown a perspective view of an embodiment of a single panel according to the invention. The panel basically comprises a substantially rigid frame consisting of lateral edge portions 4 and end portions 12 joined by corner portions 13, which will be described subsequently. Across the opening defined by the frame 4, 12 there is suspended a fabric 8, the fabric and the frame thus according to this embodiment forming a rectangular panel generally designated by reference numeral 2.

The panel 2 could in principle be of any dimensions, but typical dimensions would be approximately 2×4 meters. Hence, in order to attain sufficient lateral rigidity, a number of laterally extending beams 9 are provided on the rear side of the panel attached to either of the two lateral portions 4 of the frame. Apart from providing the necessary rigidity to the panel, at least some of these beams 9 serve as a means for suspending the panels from the fixed structure of the ceiling in a manner to be described in detail in the following.

The latter function could however also be provided with protrusions formed as an integral part of the frame or somehow attached to the frame in case of the frame being itself sufficiently rigid.

Figure 3:
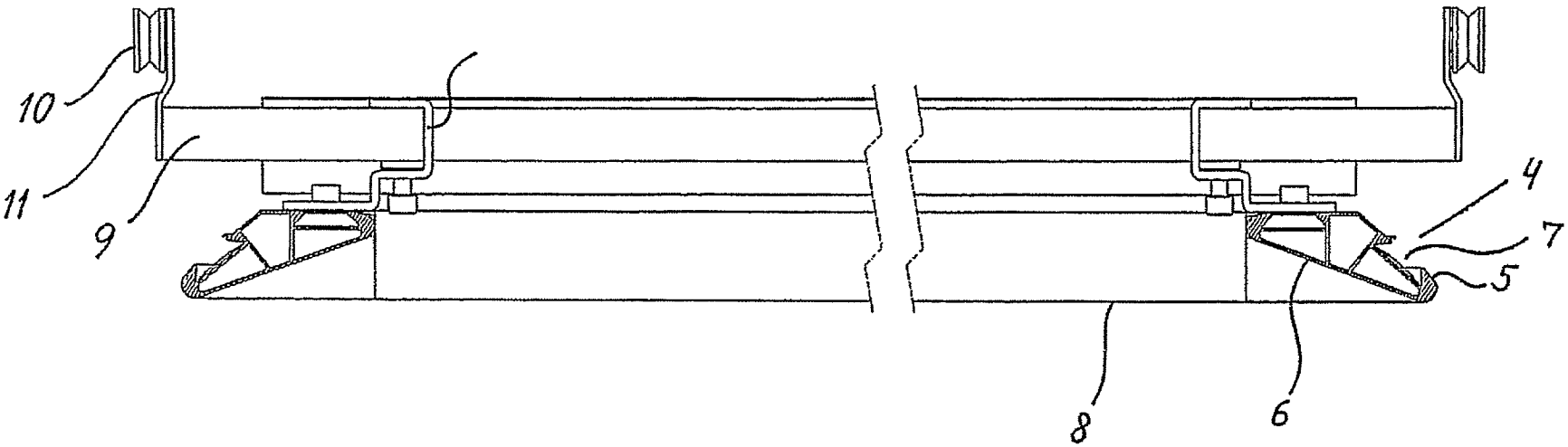
FIG. 3 is a cross sectional view of the panel shown in FIG. 2.

A lateral cross sectional view of a panel according to the invention is shown in FIG. 3. A specific design of the frame 4 is apparent from FIG. 3, the cross section of the frame according to this design being of a substantially triangular shape comprising rounded edge portions 5 and a bottom portion 6. The bottom portion is inclined relative to the general plane of the panel, whereby the fabric 8 suspended over the opening through the frame only rests against the rounded edge portion 5. On one of the legs of the triangle there is provided attachment means for the fabric and various alternative embodiments of these attachment means are described in the following. Along the upper part of the panel, the laterally extending beams 9 are situated attached to the frame by suitable means and at least some of these beams 9 are on either end hereof provided with rail wheels 10 attached to the end faces of the beams by appropriate fittings 11.

A variety of different fabrics can be used according to the specific application and pertinent characteristics of the fabric are for instance its transparency to light and/or sound and its fire-retarding ability. A presently preferred material is woven fibreglass. It should be noted, however, that a rigid panel could also replace the flexible material, if desired.

Figure 4:
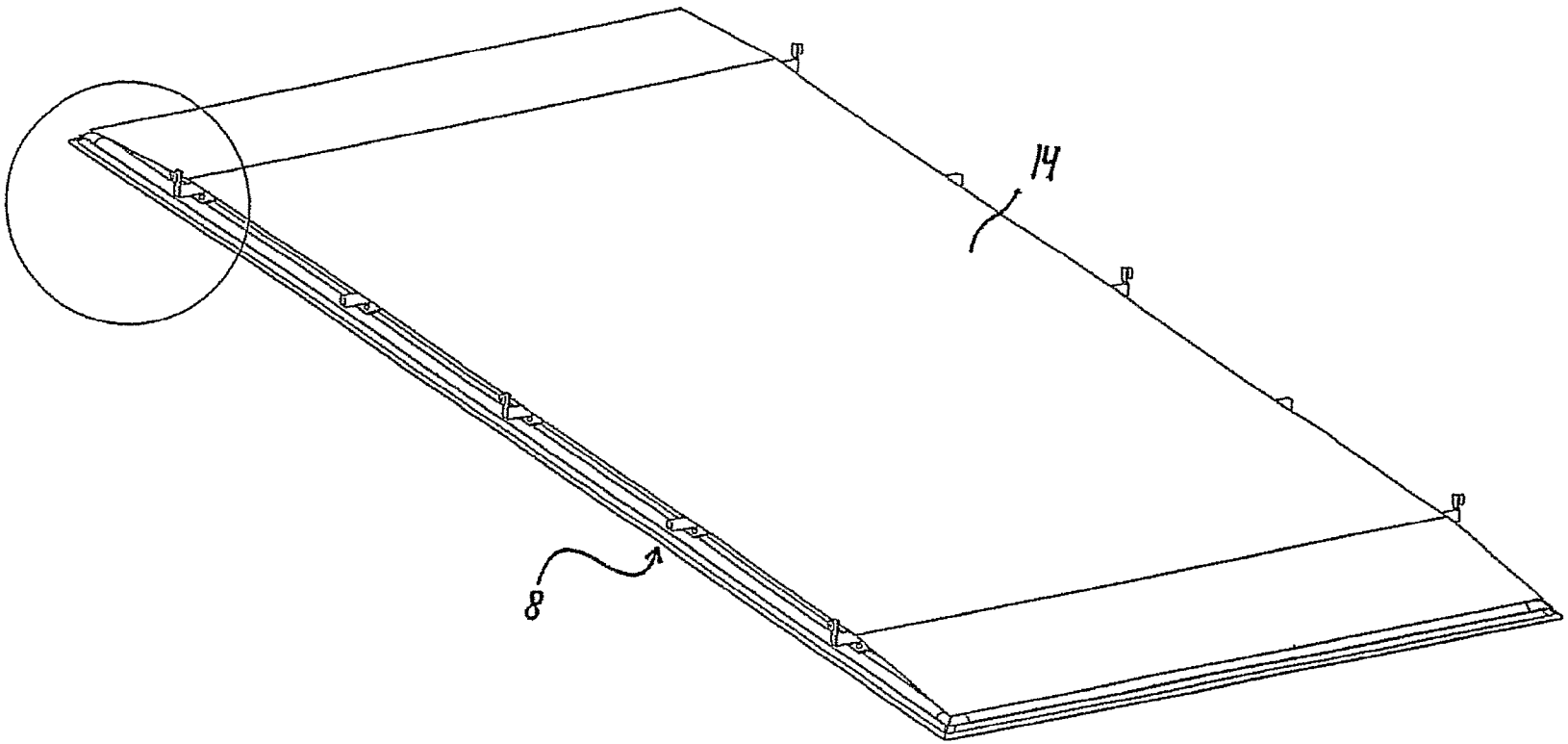
FIG. 4 is a perspective view of the panel shown in FIG. 2 seen from the rear side hereof and provided with a sound-damping fabric extending over the rear side of the panel.

The rear part of the panel can be left open, but it is also possible in addition to the fabric suspended over the opening through the frame as described above to provide the frame with additional layers of material, for instance in order to influence its acoustical properties, thermal properties, etc. An example of this is shown in FIG. 4, where the rear part of the panel has been covered by an additional fabric 14 stretched over the rear part of the panel. Such fabric could if desired be replaced by a substantially rigid panel, or a panel—for instance of mineral wool etc.—could be included between layers of fabric suspended over the front and rear parts of the panel.

Figure 5A:
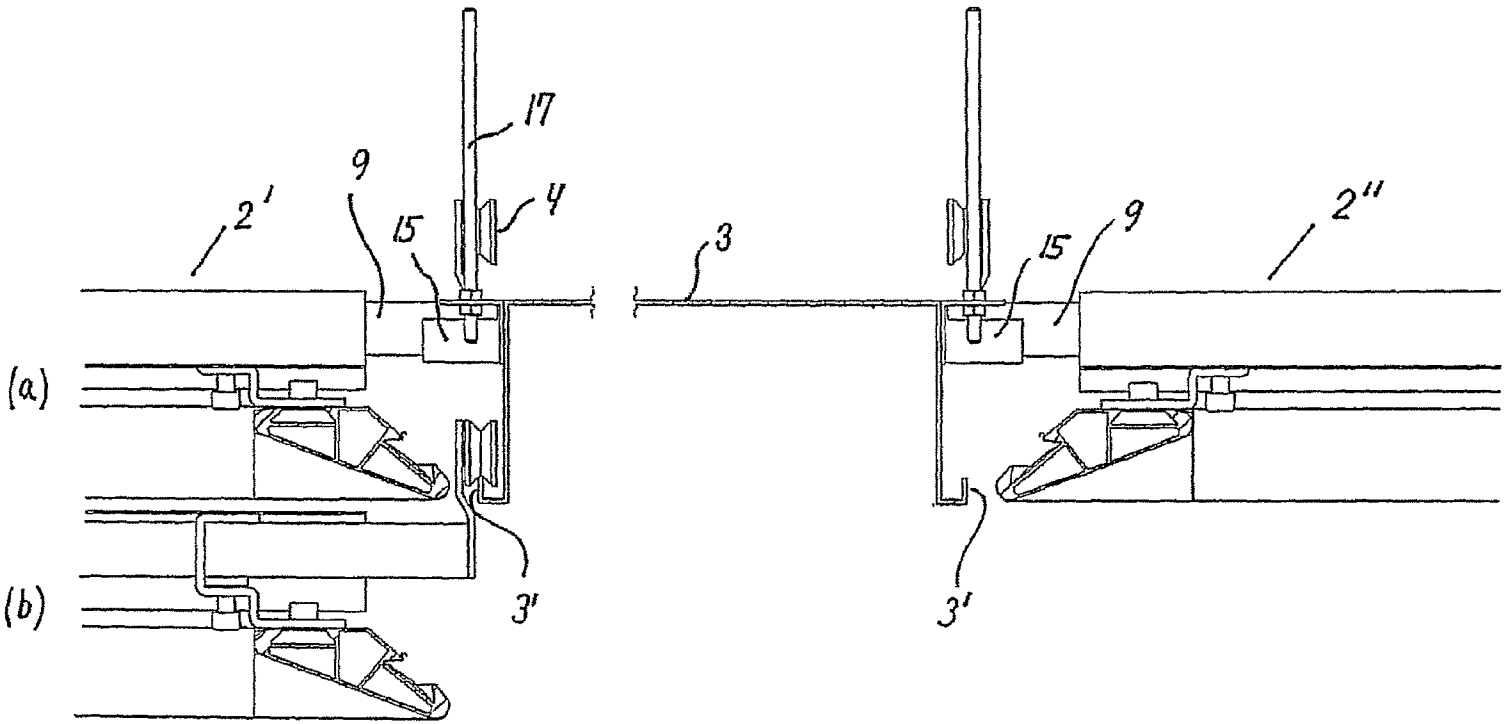
FIG. 5*a* is a cross sectional view of two adjacent rows of panels in a system according to the invention as shown in FIG. 1, depicting panels suspended in their normal (upper) position and in their displaceable (lower) position.

Referring now to FIG. 5*a*, there is shown a detail of the system of panels according to the embodiment of the invention shown in FIG. 1. Specifically the Figure shows panels 2' and 2" belonging to two adjacent rows of the system shown in FIG. 1 and separated from each other by the intermediate channel 3 as described previously. The cross section of the channel 3 is of an inverted U-shape with a substantially plane upper surface and substantially plane side portions forming the legs of the U-shape. The lower parts of the legs of the U are bent approximately 180 degrees to form rail members 3' running along the longitudinal direction of the channel 3. The channel 3 is fixed to the solid structure of the building, in this case to the (not shown) ceiling above the system of panels by suitable attachment means 17 distributed along the length of the channel.

At the upper part of the side portions of the channel there are provided saddle members 15 open upwardly and at the end facing the panels and formed to accommodate the transversal beams 9 mounted on each of the panels as described previously. As shown in more detail in FIG. 5*c*, the beams 9 and the saddle members 15 are of a substantially square cross section in this embodiment, but it is understood that other cross sectional shapes could also be envisaged.

Figure 5B:
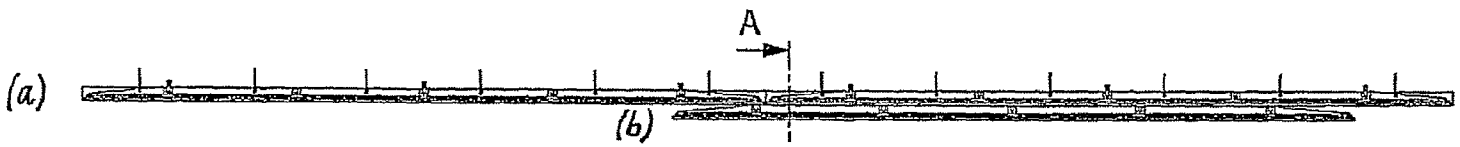
FIG. 5*b* shows displacement of a panel below an upper row of panels.
Figure 5C:
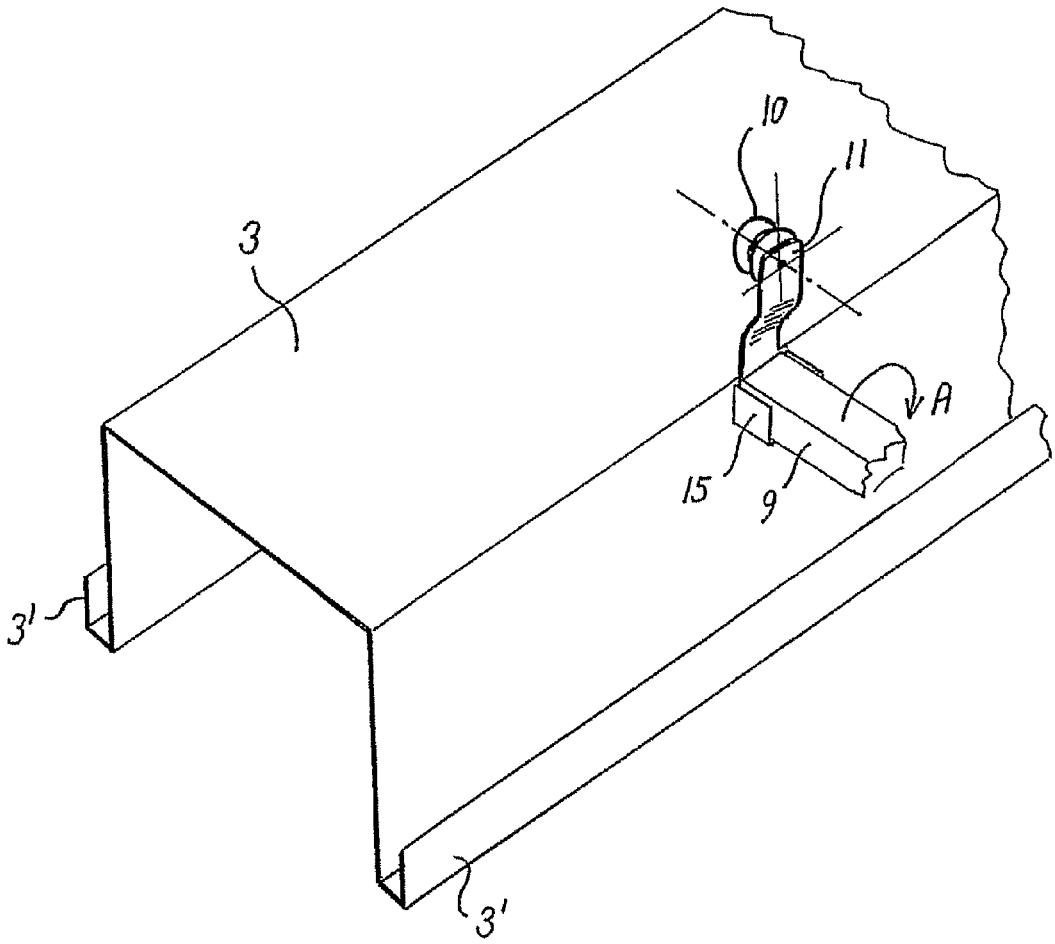
FIG. 5*c* is a schematic representation of a first embodiment of the suspension and guide system for the panels.

As perhaps most apparent from FIG. 5*c*, the panels can be moved from an upper level (a) in which they form a portion of the complete system of panels, for instance a suspended ceiling, and at which level they are in a fixed relation to the system as determined by the position of the saddle members 15 on the corresponding side portions of the channels 3 downwards to a lower level (b), in which position they can be displaced in the direction of the corresponding row and underneath panels of that row situated at the upper level (a). This displacement is shown in FIG. 5*b*. The movement from the upper level (a) to the lower level (b) is accomplished by lifting the beams 9 of the panel to be lowered upwardly out of the corresponding saddle members 15 as indicated by the arrow A in FIG. 5*c*. The panel is then lowered, so that the rail wheels 10 of the panel are brought to rest on the corresponding rail members 3' on the side portions of the channel 3. The panel can now be displaced along the rail members 3' to a desired position, for instance underneath an adjacent panel of the particular row, whereby a passage to the space above the system of panels will be provided for instance for access to installations above the suspended ceiling.

The rail wheels 10 are attached to the end faces of the beams 9 by means of suitable fittings 11.

Figure 6A:
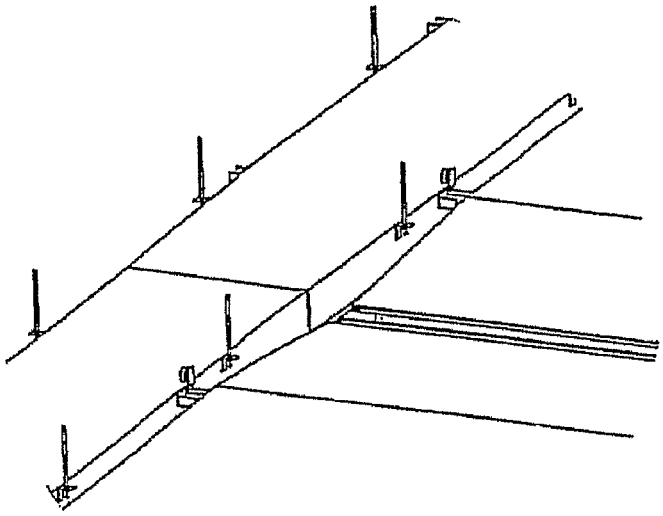
FIGS. 6*a*, 6*b* and 6*c* show in perspective view various steps performed for displacement of a panel below an adjacent panel.
Figure 6B:
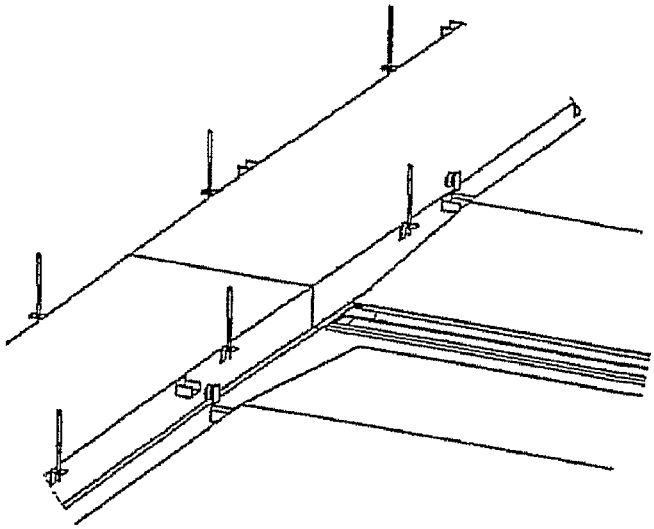
Figure 6C:
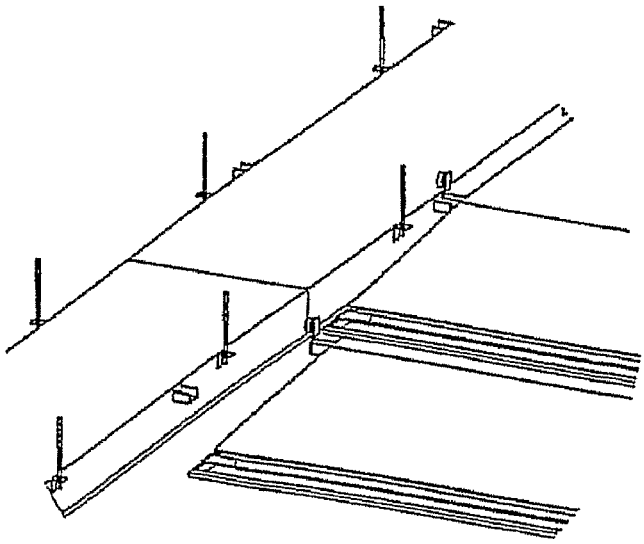

Movement of a panel from the upper level (a) to the lower level (b) and a subsequent displacement of the panel along the particular row and underneath a panel situated at the upper level (a) is shown in perspective in FIGS. 6*a*, 6*b* and 6*c*.

Figure 5D:
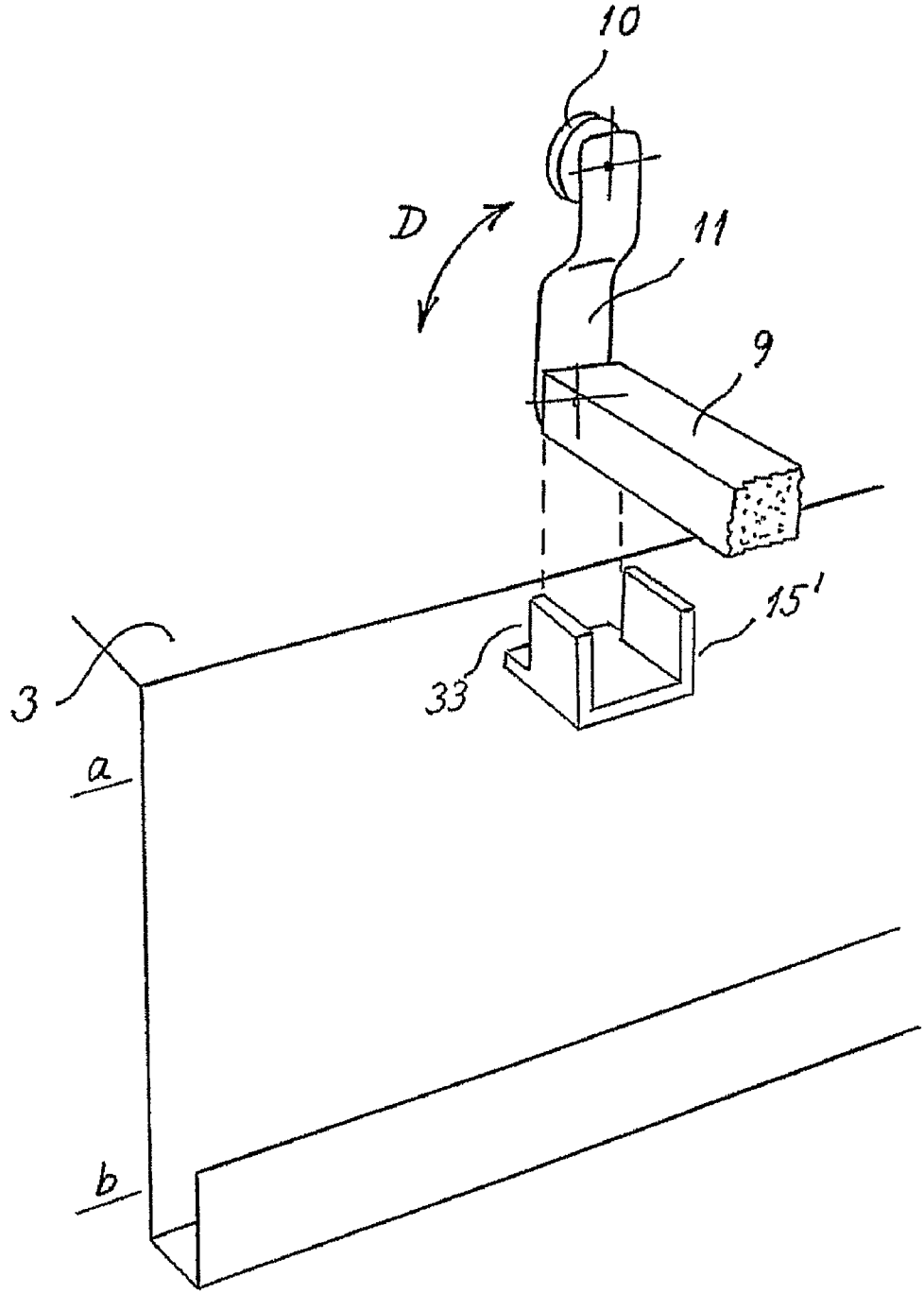
FIG. 5*d* is a schematic representation of a second embodiment of the suspension and guide system for the panels.
Figure 5E:
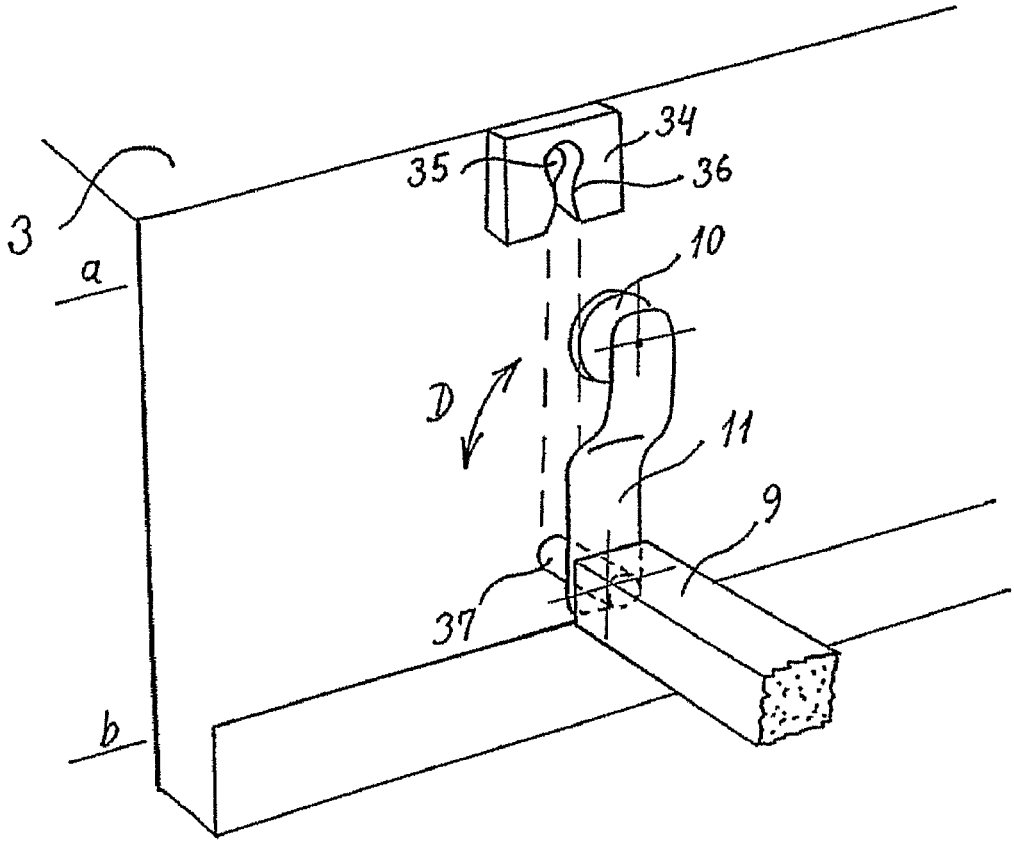
FIG. 5*e* is a schematic representation of a third embodiment of the suspension and guide system for the panels.
Figure 5F:
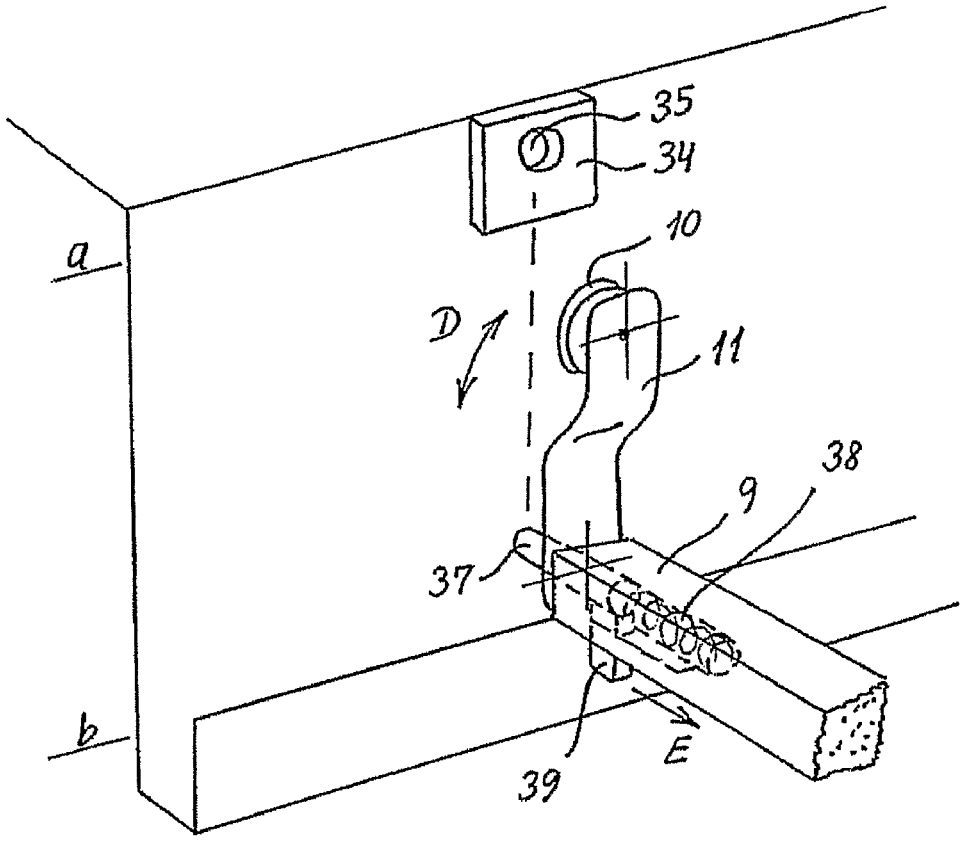
FIG. 5*f* is a schematic representation of a fourth embodiment of the suspension and guide system for the panels.

A variety of alternative holder means for fixing the panels at the first level (a) can be devised and three specific embodiments hereof are depicted in FIGS. 5*d*, 5*e* and 5*f*, respectively.

Thus FIG. 5*d* shows holder means 15' in principle corresponding to those shown in FIG. 5*c* (ref. numeral 15) and described in relation hereto. The only difference is that the holder means 15' are provided with upwardly open slots 33 facing the side surface of the channel 3 and that the fitting 11 of the rail wheel 10 is mounted for rotation as indicated by the arrow D at the end of the corresponding beam 9. Thus, when the panel is situated at the first level (a), the fitting 11 with the rail wheel 10 can be brought into a position where it extends substantially parallel with the upper surface of the channel 3, thereby leaving the space above the panels free of these fittings and wheels so that these do not interfere with installations in the space above the panels.

Referring now to FIG. 5*e* there is shown a different embodiment of holder means 34 in the form of a body, which could for instance be shaped as a box as shown in the Figure and provided with a central recess 35 of a cross-sectional shape corresponding to a mating tap 37 provided at the end face of the beam 9. The holder means 34 is furthermore provided with a downwardly extending passageway, which is made more narrow than the tap 37 through which the tap 37 can be inserted into the central recess 35. It is understood that this embodiment requires that either the holder means 34 or the tap 37 be made of a suitably resilient material to allow the tap to pass through the passageway 36 and into the recess 35. Also according to this embodiment, the fitting 11 can be mounted for rotation (arrow D) as described above.

Finally referring to FIG. 5*f* there is shown an alternative version of the holder means shown in FIG. 5*e*. In this embodiment, the passageway 36 has been omitted leaving only the recess 35 in the holder means 34. Instead the tap 37 can be retracted towards the end of the beam 9, the tap being accommodated in a suitable channel in the beam and provided with biasing means 38 (for instance a compression spring) biasing it towards the channel 3 and with a grip member 39 for manual retraction of the tap (arrow E).

It is understood that the above embodiments of holder means and corresponding means on the panels are only to be regarded as non-limiting examples and that other embodiments may be devised by a person skilled in the art departing form the scope of the invention as defined by the claims.

Figure 7:
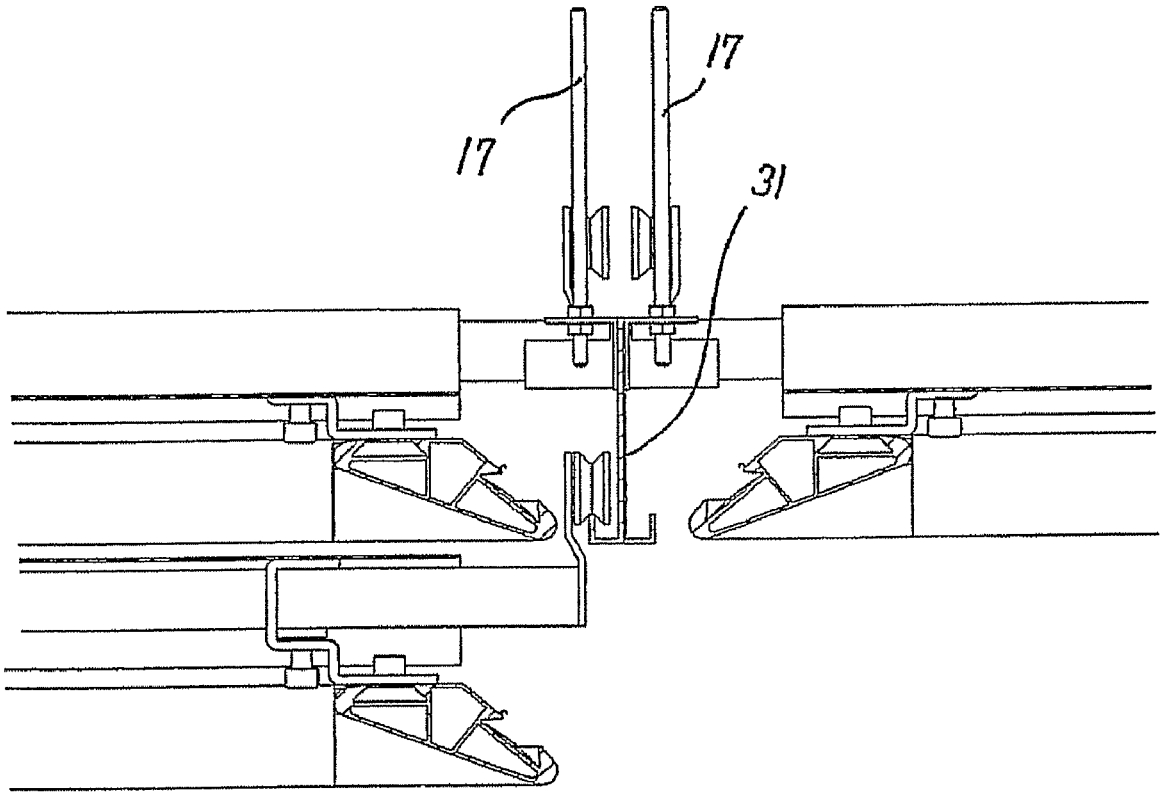
FIG. 7 is a cross sectional view of a detail of an alternative embodiment of a system of panels according to the invention.

As mentioned initially the layout of the system of panels according to the invention could deviate from the one shown in FIG. 1, for instance by the omission of some or all of the intermediate channels 3. A detail of a corresponding embodiment of the system according to the invention is shown in FIG. 7, where the U-shaped channel 3 has been replaced by a vertically extending fitting 31 on the lower end of which the rail members 3' are formed. In this embodiment also the two attachment means 17 for attachment of the system to the solid structure above could of course be replaced by a single attachment means if desired.

Returning now to the layout of the individual panels according to the invention there are shown three alternative attachment means for releasable attachment of the fabric 8 to the frontal portion of the rigid frame 4, 12. By either of these alternative means it is possible to attach the fabric in the required tensioned manner over the opening of the frame and subsequently to dismantle the fabric from the frame for replacement, for instance in case of a damaged fabric or if a change of appearance should be desired.

Figure 8A:
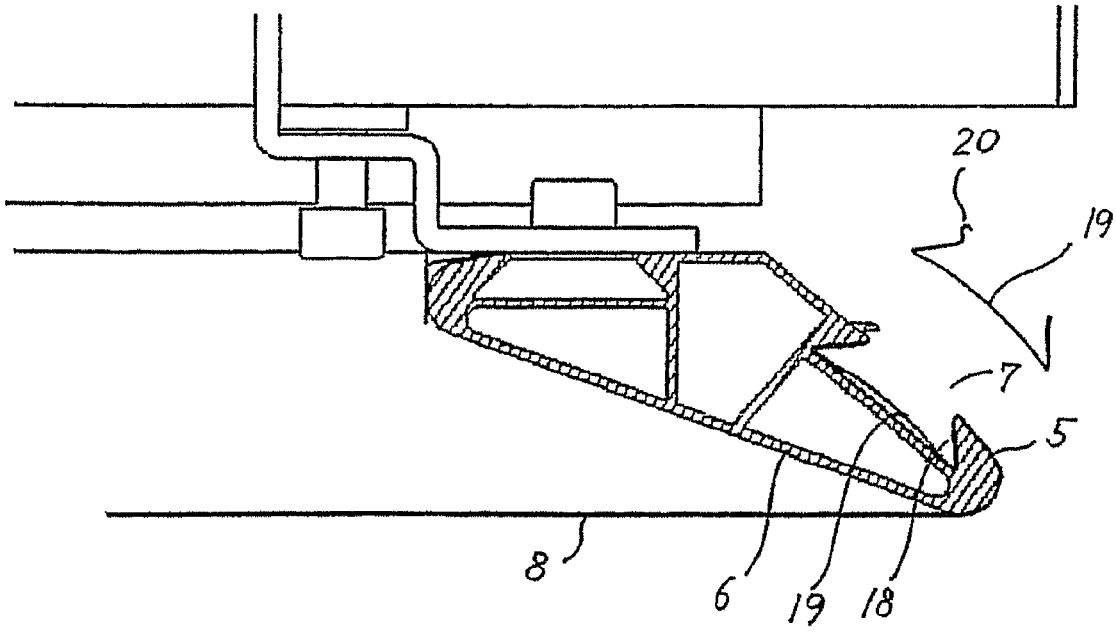
FIGS. 8*a*, 8*b* and 8*c* are three alternative embodiments of releasable attachment means for the fabric to the rigid frame.

With reference to FIG. 8*a*, there is thus shown a first embodiment of releasable attachment means according to the invention for the fabric stretched over the opening of the frame. These means comprise a dovetail slot 18 extending over the length of the corresponding part of the frame (i.e. along each of the lateral portions 4 of the frame and each of the end portions 12 of the frame) into which slot the fabric 8 is introduced. Specifically the fabric 8 is thus stretched over the opening of the frame, directed alongside the rounded edge portion 5 of the frame and from the edge portion 5 into the slot 18. After introduction into the slot the fabric is retained in the slot by means of a resilient clip 19 also of a dovetail shape, which due to its resiliency can be introduced into the slot 18. The clip is preferably provided with some kind of gripping means 20 to facilitate subsequent removal from the dovetail slot 18 in case removal of the fabric from the frame is desired.

Figure 8B:
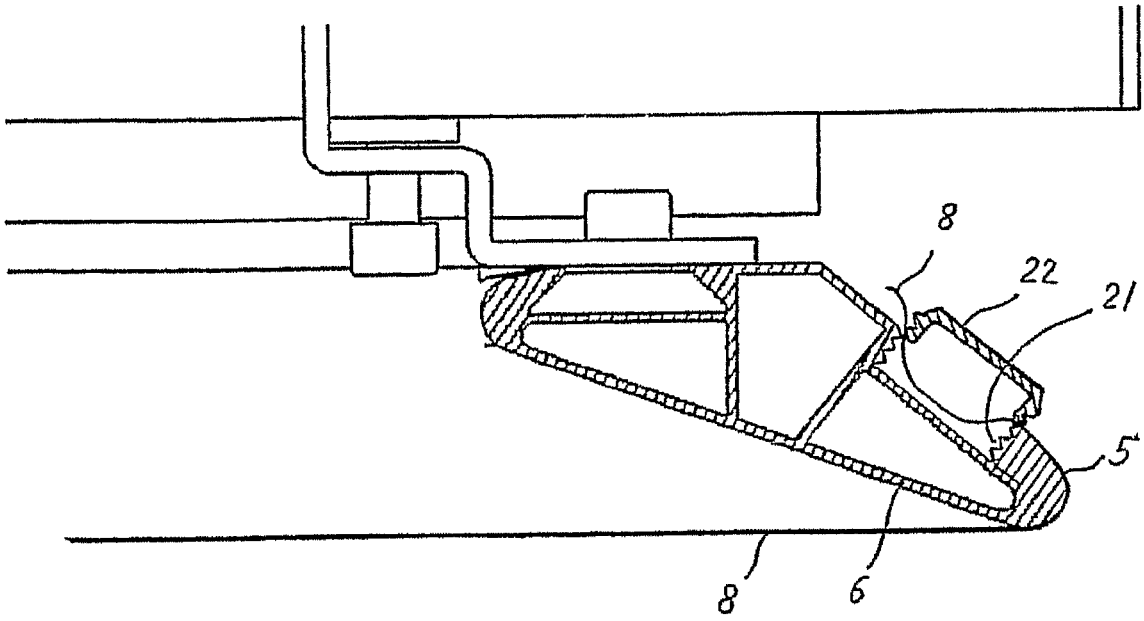

An alternative embodiment of attachment means bearing some resemblance to the one shown in FIG. 8*a* is shown in FIG. 8*b*. According to this embodiment, the dovetail slot of the embodiment shown in FIG. 8*a* is replaced by a slot comprising serrated side walls formed for engagement with a mating resilient clip 22, which could (although this is not shown) also be provided with gripping means for easy removal of the clip from the slot.

Figure 8C:
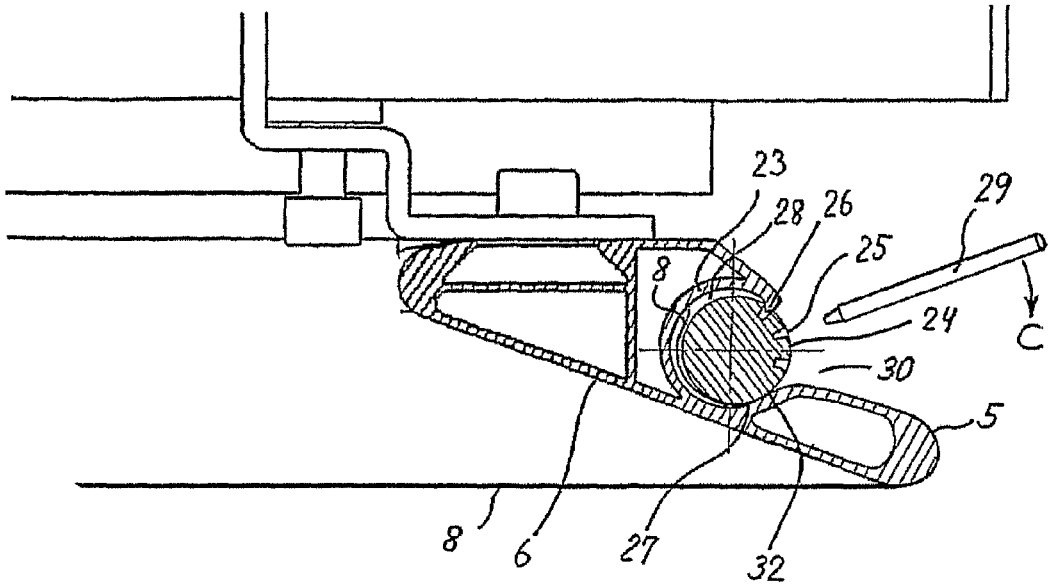
Figure 8D:
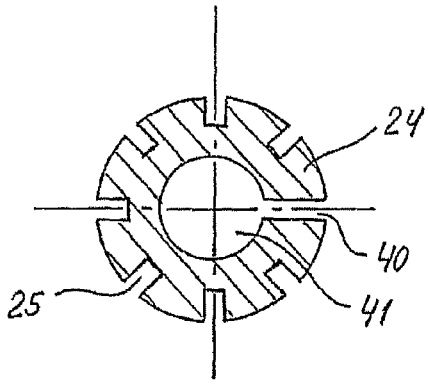
FIG. 8*d* is a detailed view of a retainment cylinder shown in FIG. 8*c;*

A further alternative embodiment of attachment means for the fabric is shown in FIG. 8*c*. According to this embodiment, the dovetail slot and the slot with serrated side walls shown in FIGS. 8*a* and 8*b* have been replaced by a longitudinally extending cylindrical retainment channel 23 provided with an insertion opening 30 for insertion of the fabric 8 and for access to a retainment cylinder 24 accommodated within the channel and extending longitudinally throughout the length of the channel. The diameter of the retainment cylinder 24 is somewhat smaller than the diameter of the retainment channel, whereby a space is left between the channel and the cylinder at the portion of the channel substantially opposite the insertion opening 30. The circumferential surface of the cylinder is provided with radially extending notches, of which only some are shown in the Figure formed for engagement with a protrusion extending radially inwards towards the longitudinal axis of the cylinder 24. Preferably the notches are formed along the complete circumference of the cylinder as shown in FIG. 8*d*. The circumferential surface of the cylinder could be knurled in order to increase friction between this surface and the fabric at a retaining contact surface 27 of the cylinder.

The function of the attachment means for the fabric 8 according to the embodiment shown in FIG. 8*c* is as follows: Initially, fabric 8—without tension—is introduced through the opening 30 and into the space 28 between the retainment channel and the cylinder. The cylinder 24 is rotated by means of a suitably designed tool 29, which can engage notches 25 formed in the cylinder, in the direction of the arrow C in the Figure. Due to friction between the knurled circumferential surface of the cylinder and the fabric, the fabric is pulled through the opening 30 and into the space 28 behind the cylinder. By this rotation, tension is built up in the fabric and the tension tends to pull the cylinder in the direction of the opening 30, whereby the fabric becomes clamped in the region 27 between the knurled circumferential surface of the cylinder and the corresponding contact face 32 of the frame. By means of the notches 25 and the tool 29, an appropriate tension can thus be attained in the fabric. If it is subsequently desired to loosen the fabric from the frame, the retainment cylinder 24 can be rotated in the opposite direction.

A modification of the cylinder 24 shown in FIG. 8*c* is shown in FIG. 8*d* comprising the pattern of notches 25 mentioned above. One of these notches 40 is, however, according to this modification extended radially inwards to a central region 41 of the cylinder 24. During initial attachment to the frame, the fabric is introduced through this extended notch 40 and into the central region 41, which can accommodate a sufficiently large amount of fabric, and after this the cylinder 24 is rotated as described above to tension the fabric. The provision of the extended notch and the central region facilitates tensioning of the fabric at the initial phase, where practically no tension is yet built up in the fabric.

Figure 9A:
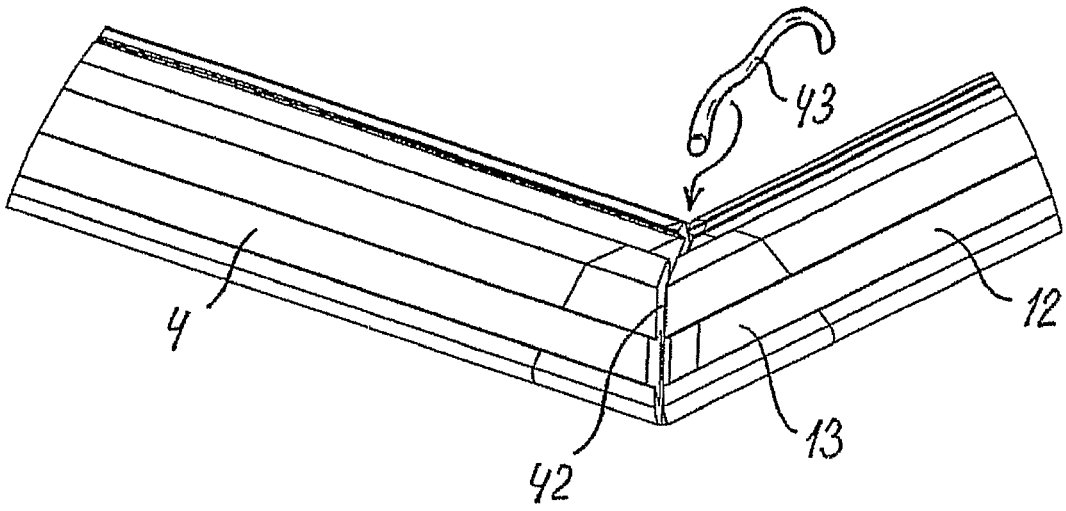
FIGS. 9*a* and 9*b* are schematic perspective representations of corner sections of the frame of the panels according to the invention.
Figure 9B:
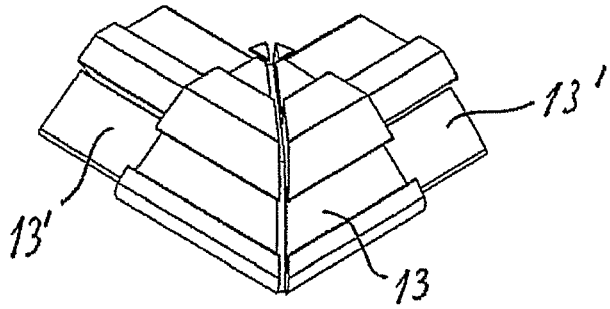

Referring to FIGS. 9*a* and 9*b* there is shown a schematic perspective representation of an embodiment of corner sections of the frame of the panels according to the invention.

The corner section 13 according to this embodiment is provided with extensions 13' for insertion into corresponding profiles of the lateral edge portion 4 and the end portion 12 of the frame. In order to facilitate attachment of the fabric to the corner section, the corner section can be provided with a groove 42 for insertion of the corner portion of the fabric, and this portion of the fabric can furthermore be retained in the groove 42 by means of a resilient member 43, for instance a piece of flexible cord of a suitable diameter. Other retainment means can of course also be envisaged. The corner sections make it possible to assemble or disassemble the frame on site, which facilitates transport of the frame.

Figure 10:
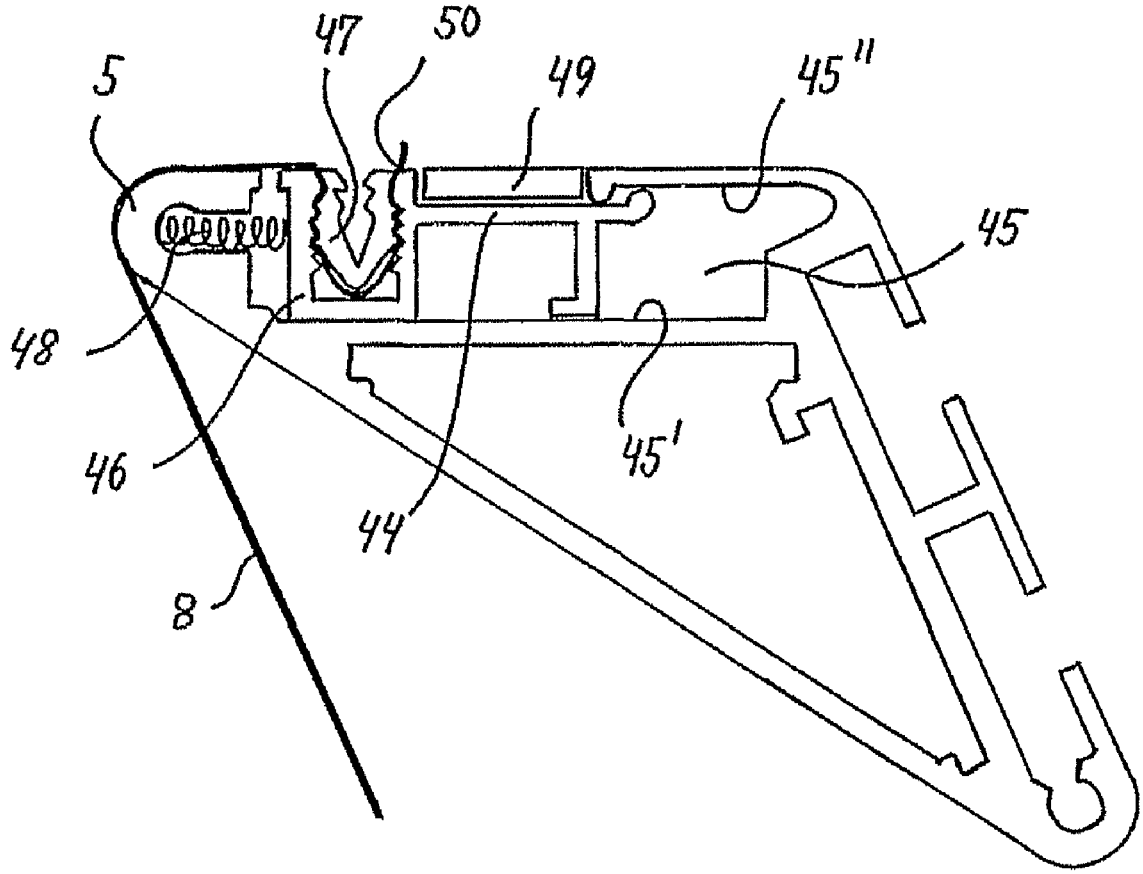
FIG. 10 is a cross sectional view of a further embodiment of releasable attachment means according to the invention for the fabric to the frame.

Referring now to FIG. 10 there is shown a cross sectional view of a further embodiment of attachment means for the fabric 8 to the frame. In one of the lateral side portions 4 of the frame there is provided a laterally displaceable member essentially comprising two portions, i.e. a guide portion 44 of such a shape that it can be at least partly accommodated within a corresponding guide channel 45 formed in the frame and displaced laterally herein, i.e. away from or towards the edge portion 5 of the frame. The other portion of the laterally displaceable member is the attachment portion 46, to which the fabric to be stretched over the open region of the frame is fastened. The fastening is accomplished by means of a resilient clip 47, but other means would also be conceivable. The laterally displaceable member is urged away from the edge portion 5 of the frame for instance by means of a compression spring 48. During insertion of the fabric in the attachment portion 46 of the laterally displaceable member, this member can be prevented from movement away from the edge portion 5 of the frame by means of a spacer 49 inserted between the laterally displaceable member and the frame structure. Once the fabric 8 is fastened appropriately, the spacer 49 is removed and the laterally displaceable pre-tension member caused by the spring 48 will maintain the fabric properly stretched out over the opening of the frame, even though the properties of the fabric may change over time and/or the frame for some reason should become slightly deformed. After mounting of the fabric, superfluous fabric is cut off at the edge of the frame, as indicated by reference numeral 50.

Although various embodiments of the present invention have been shown and described in the preceding parts of the detailed description, it is understood that a person skilled in the art may conceive other embodiments of the invention without departing from the scope of the invention as defined by the following claims.

REFERENCE NUMERALS

1. system of panels
2. panel
3. intermediate channel
4. lateral portion of frame
5. edge portion of frame
6. bottom portion of frame
7. attachment means for fabric
8. fabric
9. transversal beam
10. rail wheel
11. fitting
12. end portion of frame
13. corner portion of frame
14. sound-attenuating material
15. saddle
16. rail
17. attachment means
18. dovetail slot
19. resilient clip
20. gripping means of resilient clip
21. serrated portion of attachment means for fabric
22. resilient clip
23. cylindrical retainment channel
24. retainment cylinder
25. radial notch
26. protrusion
27. retaining contact surface
28. space between retainment channel and cylinder
29. tool
30. insertion opening for fabric in frame
31. fitting
32. contact face
33. slot
34. holder means
35. recess
36. passageway
37. tap
38. biasing means
39. grip member
40. radial notch
41. central region of retainment cylinder
42. groove
43. resilient member
44. guide portion of laterally displaceable member
45. guide channel
45' first inner surface of guide channel
45" second inner surface of guide channel
46. attachment portion of laterally displaceable member
47. resilient attachment clip
48. compression spring
49. spacer
50. end of fabric

The invention claimed is:

1. A panel for use in a system of suspended panels, wherein the system of suspended panels includes at least one row of panels and a suspension and guide system for the row of panels whereby at least some of the panels of the at least one row can be moved from a first level to a second level, in which second level the panels can be displaced along panels situated at the first level, thereby providing access through the system of panels, said panel comprising:

a substantially rigid frame defining a periphery and an open region inside of the periphery, the frame including a holder means for releasably suspending the panel to the suspension and guide system, and a displacement means for allowing displacement of the frame relative to the suspension and guide system;

a fabric covering the open region of the frame and thus forming a main portion of a surface of the frame;

the frame further including, at least along portions of a periphery thereof, laterally displaceable attachment members accessible from outside the frame for attachment of the fabric to the frame, where a lateral displacement of said laterally displaceable attachment members away from a corresponding edge portion of the frame results in tensioning of the fabric across the open region of the frame.

2. A panel according to claim 1, wherein the frame further includes two opposing longitudinal edges, and wherein said holder means includes a pattern of protrusions provided on the two opposing longitudinal edges of said frame.

3. A panel according to claim 1, wherein the frame further includes two opposing longitudinal edges, and wherein said holder means includes laterally extending beams with end portions thereof connecting the two opposing longitudinal edges of said frame.

4. A panel according to claim 1, wherein the frame further includes opposing lateral portions, and wherein said displacement means includes rail wheels attached to the opposing lateral portions of the frame.

5. A panel according to claim 1, wherein the fabric is a flexible sheet of glass fibre.

6. A panel according to claim 1, further including one or more further layers of material above said fabric.

7. A panel according to claim 1, wherein the frame further includes opposing lateral portions, opposed end portions, and corner portions which releasably attach the lateral portions and end portions.

8. A panel according to claim 1, wherein the frame further includes a guide channel, and wherein each said laterally displaceable attachment member comprises a guide portion to be guided within the guide channel in the frame and an attachment portion for attachment of the fabric to a remainder of the laterally displaceable attachment member.

9. A panel according to claim 8, wherein said fabric is releasably attached to said attachment portion by a resilient clip.

10. A panel according to claim 1, wherein said laterally displaceable attachment member is pre-tensioned away from said corresponding edge portion of the frame.

11. A panel according to claim 1, further including, for each laterally displaceable attachment member, a spacer inserted between the laterally displaceable attachment member and the frame in order to limit the lateral displacement of the laterally displaceable attachment member during attachment of the fabric to the frame.

12. A panel for use in a system of suspended panels, said panel comprising:

a substantially rigid frame defining an open region, the frame including a lateral portion;

a flexible sheet of material covering the open region of the frame and thus forming a main portion of a surface of the frame;

the frame further including, at least along portions of a periphery thereof, laterally displaceable attachment members accessible from outside the frame for attachment of the flexible sheet of material to the frame, where a lateral displacement of said laterally displaceable attachment members away from a corresponding edge portion of the frame results in tensioning of the flexible sheet of material across the open region of the frame; and the frame still further including opposing lateral portions, opposed end portions, and corner portions which releasably attach the lateral portions and end portions.

13. A panel according to claim 12, wherein the flexible sheet of material is a flexible sheet of glass fibre.

14. A panel according to claim 12, further including one or more further layers of material above said flexible sheet of material.

15. A panel according to claim 12, wherein the frame further includes a guide channel, and wherein each said laterally displaceable attachment member comprises a guide portion to be guided within the guide channel in the frame and an attachment portion for attachment of the flexible sheet of material to a remainder of the laterally displaceable attachment member.

16. A panel according to claim 15, wherein said flexible sheet of material is releasably attached to said attachment portion by a resilient clip.

17. A panel according to claim 12, wherein said laterally displaceable attachment member is pre-tensioned away from said corresponding edge portion of the frame.

18. A panel according to claim 12, further including, for each laterally displaceable attachment member, a spacer inserted between the laterally displaceable attachment member and the frame in order to limit the lateral displacement of the laterally displaceable attachment member during attachment of the flexible sheet of material to the frame.

19. A panel according to claim 12, wherein said flexible sheet of material is a fabric.

20. A panel for use in a system of suspended panels, said panel comprising:

a substantially rigid frame defining an open region, the frame including a lateral portion;

a flexible sheet of material covering the open region of the frame and thus forming a main portion of a surface of the frame;

the frame further including, at least along portions of a periphery thereof, laterally displaceable attachment members accessible from outside the frame for attachment of the flexible sheet of material to the frame, where a lateral displacement of said laterally displaceable attachment members away from a corresponding edge portion of the frame results in tensioning of the flexible sheet of material across the open region of the frame;

the frame still further including a guide channel, and wherein each said laterally displaceable attachment member comprises a guide portion to be guided within the guide channel in the frame and an attachment portion for attachment of the flexible sheet of material to a remainder of the laterally displaceable attachment member; and wherein said flexible sheet of material is releasably attached to said attachment portion by a resilient clip.

21. A panel according to claim 20, wherein the flexible sheet of material is a flexible sheet of glass fibre.

22. A panel according to claim 20, further including one or more further layers of material above said flexible sheet of material.

23. A panel according to claim 20, wherein the frame further includes opposing lateral portions, opposed end portions, and corner portions which releasably attach the lateral portions and end portions.

24. A panel according to claim 20, wherein said laterally displaceable attachment member is pre-tensioned away from said corresponding edge portion of the frame.

25. A panel according to claim 20, further including, for each laterally displaceable attachment member, a spacer inserted between the laterally displaceable attachment member and the frame in order to limit the lateral displacement of the laterally displaceable attachment member during attachment of the flexible sheet of material to the frame.

26. A panel according to claim 20, wherein said flexible sheet of material is a fabric.

27. A panel for use in a system of suspended panels, said panel comprising:

a substantially rigid frame defining an open region, the frame including a lateral portion;

a flexible sheet of material covering the open region of the frame and thus forming a main portion of a surface of the frame;

the frame further including, at least along portions of a periphery thereof, laterally displaceable attachment members accessible from outside the frame for attachment of the flexible sheet of material to the frame, where a lateral displacement of said laterally displaceable attachment members away from a corresponding edge portion of the frame results in tensioning of the flexible sheet of material across the open region of the frame; and for each laterally displaceable attachment member, a spacer inserted between the laterally displaceable attachment member and the frame in order to limit the lateral displacement of the laterally displaceable attachment member during attachment of the flexible sheet of material to the frame.

28. A panel according to claim 27, wherein the flexible sheet of material is a flexible sheet of glass fibre.

29. A panel according to claim 27, further including one or more further layers of material above said flexible sheet of material.

30. A panel according to claim 27, wherein the frame further includes opposing lateral portions, opposed end portions, and corner portions which releasably attach the lateral portions and end portions.

31. A panel according to claim 27, wherein the frame further includes a guide channel, and wherein each said laterally displaceable attachment member comprises a guide portion to be guided within the guide channel in the frame and an attachment portion for attachment of the flexible sheet of material to a remainder of the laterally displaceable attachment member.

32. A panel according to claim 31, wherein said flexible sheet of material is releasably attached to said attachment portion by a resilient clip.

33. A panel according to claim 27, wherein said laterally displaceable attachment member is pre-tensioned away from said corresponding edge portion of the frame.

34. A panel according to claim 27, wherein said flexible sheet of material is a fabric.

* * * * *